United States Patent [19]

Granberg

[11] 4,356,816

[45] Nov. 2, 1982

[54] TRACTION DEVICE

[75] Inventor: Elof Granberg, San Rafael, Calif.

[73] Assignee: Granberg Pump and Meter Ltd., Richmond, Calif.

[21] Appl. No.: 182,551

[22] Filed: Aug. 29, 1980

[51] Int. Cl.[3] ..... A61H 1/02

[52] U.S. Cl. ..... 128/71

[58] Field of Search ..... 254/199, 221; 64/29; 128/69–75; 188/82.6

[56] References Cited

U.S. PATENT DOCUMENTS

| | | | |
|---|---|---|---|
| 951,515 | 3/1910 | Solsem | 128/71 |
| 1,577,439 | 3/1926 | Armbruster | 254/221 |
| 1,605,578 | 11/1926 | Clark | 128/71 |
| 1,642,158 | 9/1927 | Kubista | 128/71 |
| 1,915,841 | 6/1933 | Warner | 128/71 |
| 2,477,521 | 7/1949 | Martin | 64/29 |
| 2,798,481 | 7/1957 | Matthews | 128/71 |
| 2,861,565 | 11/1958 | Lapierre | 128/71 |
| 2,894,605 | 7/1959 | Leavitt | 188/82.6 |
| 3,276,444 | 10/1966 | Rice | 128/75 |
| 3,420,229 | 1/1969 | Miller | 128/71 |
| 3,554,189 | 1/1971 | Hendrickson | 128/71 |
| 3,856,003 | 12/1974 | Pfluger | 128/75 |

FOREIGN PATENT DOCUMENTS

| | | | |
|---|---|---|---|
| 92349 | 9/1968 | France | 128/71 |
| 862277 | 3/1961 | United Kingdom | 128/71 |

*Primary Examiner*—Richard J. Apley
*Assistant Examiner*—Carl Moy
*Attorney, Agent, or Firm*—Townsend and Townsend

[57] ABSTRACT

A portable traction device is disclosed. The device includes a frame which has an upper surface to support the individual to be subjected to traction. The frame has at least one mounting point at one end of the upper surface. At least one tension member emanates from beneath the frame and has a free end passing through the mounting point and back toward the upper surface of the frame. The free end of the tension member is secured to the individual who is to be subjected to traction. A takeup mechanism for applying tension to the tension member is located beneath the frame. The takeup mechanism is manually activated, usually by the patient. A system is provided for automatically decoupling the activation mechanism from the takeup mechanism when the applied tension reaches a preselected value, while maintaining the preselected tension on the tension member.

4 Claims, 8 Drawing Figures

TRACTION DEVICE

BACKGROUND OF THE INVENTION

The present invention relates to traction devices, and in particular to a portable traction device which can be operated by the individual being subjected to traction.

In most modern hospitals settings, traction is applied to a patient using an electrically controlled winch system. The system includes a mechanism for setting the necessary force of the winch needed to obtain the desired tension, and the system automatically maintains that tension on the patient.

While practical in most hospital environments, electric traction systems are impractical in many other situations in which the application of traction is desired. For example, it is often desirable to provide traction in a home environment so that persons under traction but otherwise not needing hospital attention can receive treatment at home. In addition, it is often desirable to provide traction in an emergency in a location remote from a hospital, or to have traction equipment available in a hospital emergency room. In both of these latter situations, it is desirable to have traction equipment which is readily portable.

The patent literature contains a wide variety of traction devices, some of which are portable. Applicant's investigation has revealed that the following patents shows some sort of traction device: French Pat. No. 92,349; U.S. Pat. Nos. 951,515; 1,605,578; 1,642,158; 2,798,481; 2,861,565; 3,420,229; 3,554,189. French Pat. No. 92,349 illustrates a traction device operable by the patient. However, these devices in general are inefficient, cumbersome and complex, and do not satisfy modern medical standards as to the application of traction. Specifically, these devices do not provide precise control over the amount of traction applied, and they are not failsafe in the sense of preventing the application of excess forces which can harm the patient.

SUMMARY OF THE INVENTION

The present invention provides a traction device including a frame which has an upper surface to support the individual to be subjected to traction. The frame has at least one mounting point at one end of the upper surface. At least one tension member emanates from beneath the frame and has a free end passing through the mounting point and back toward the upper surface of the frame. The free end of the tension member is secured to the individual who is to be subjected to traction. A takeup mechanism for applying tension to the tension member is located beneath the frame. The takeup mechanism is manually activated, usually by the patient. A system is provided for automatically decoupling the activation mechanism from the takeup mechanism when the applied tension reaches a preselected value, while maintaining the preselected tension on the tension member.

In the preferred embodiment of the present invention, the takeup mechanism comprises a chain mounted on laterally spaced sprockets. The activating mechanism includes a rotatable shaft passing through one of the sprockets supporting the chain. The sprocket circumscribing the shaft has a detent, and the shaft has a radial projection adapted to engage the detent. The sprocket and shaft are biased toward one another so that the projection engages the detent until a preselected tension is reached, at which time it disengages so that excess tension is not applied.

The present invention thus provides a very simple and convenient traction system which can easily be constructed so as to be portable. The entire system can be operated by the patient, thus facilitating its use in a home environment. However, the device contains a failsafe decoupling system so that excess traction forces cannot be applied by mistake.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
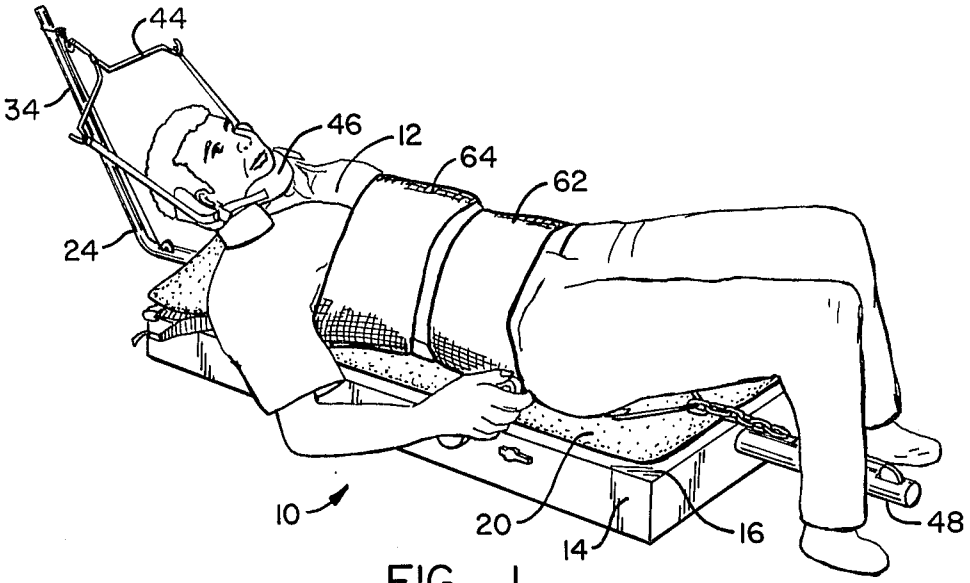
FIG. 1 is a perspective view illustrating use of the preferred embodiment of the present invention in applying pelvic and cervicle traction.

The preferred embodiment 10 of the traction device of the present invention is illustrated generally by way of reference to FIG. 1. FIG. 1 depicts a patient 12 being subjected to cervicle (neck) and pelvic traction simultaneously for purposes of illustration only. Generally speaking, the patient would be subjected to one or the other type of traction, but not both simultaneously.

Figure 4:
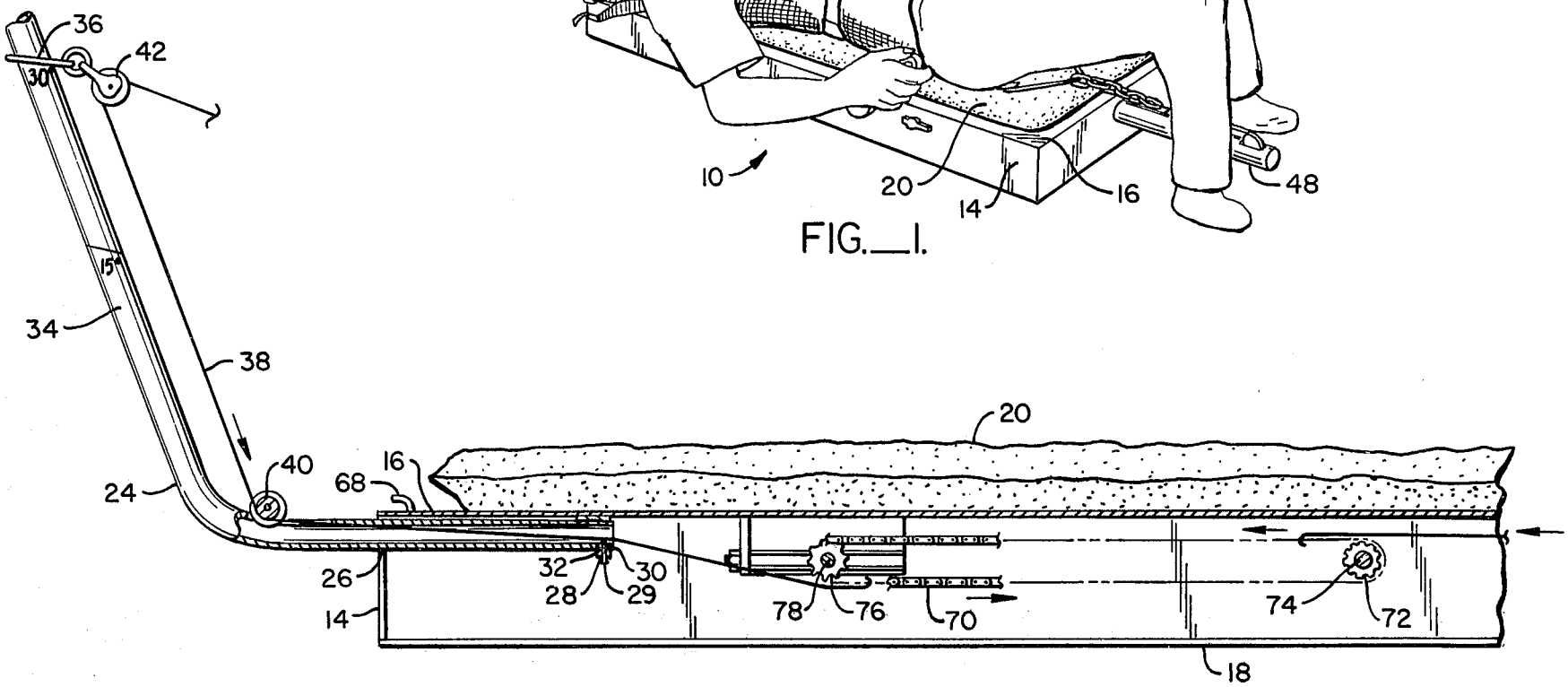
FIG. 4 is a section view taken along lines 4—4 of FIG. 3.
Figure 7:
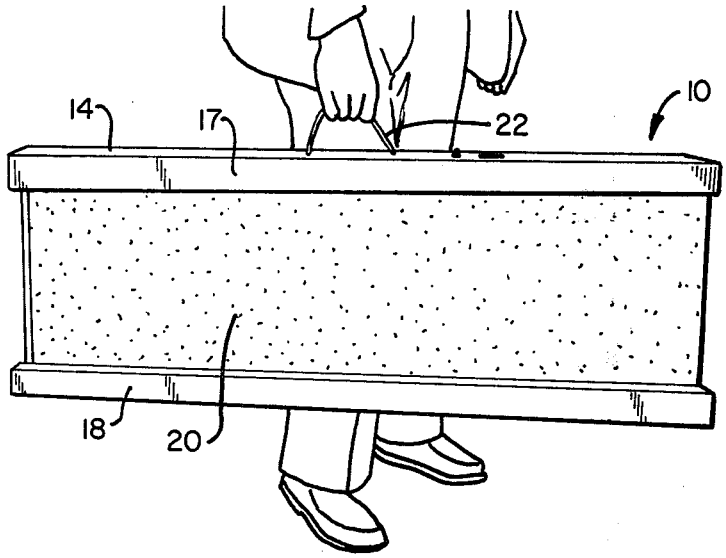
FIG. 7 is a perspective view of the traction device of FIG. 1 in its disassembled configuration for transport.

Traction device 10 includes a frame 14 which is open at the bottom (see FIGS. 2–4) and has a continuous upper surface 16. Frame 14 includes a pair of inwardly directed flanges 17, 18, and when not in use, a pad 20 is slipped into the frame and supported by flanges 17, 18, as illustrated in FIG. 7. The various implements used in the operation of the device can also be stored within frame 14, and a carrying strap 22 is provided so that the entire device is readily portable.

When traction device 10 is to be utilized to administer traction, pad 20 is removed from beneath frame 14, and placed on upper supporting surface 16 (FIGS. 1–4). A cervicle support rod 24 is removed from beneath frame 14, and is inserted into the frame through an aperture 26 at the head end of the frame. Cervicle support rod 24 penetrates an interior aperture 28 on inner plate 29. A small upwardly directed pin 30 engages a slot 32 in rod 24 so that the proper orientation of the rod is maintained.

Rod 24 includes a vertically extending portion 34. A slip ring 36 is movable vertically along vertically extending portion 34 of rod 24, and can be positioned and locations marked as 15°, 30° and 45° and at other intermediate locations. A cervicle traction cable 38 emanates from beneath frame 14, passes through the center of cervicle support rod 24 for a portion of its length, leaves the support rod at pulley 40, turns an idler pulley 42 attached to slip ring 36, and connects to spreader 44. Spreader 44 is attached to a cervicle halter 46 for the application of cervicle traction to patient 12.

Pelvic traction support rod 48, carried within frame 14 when not in use, is removed and inserted in the foot end frame 14 for the application of pelvic traction. Rod 48 penetrates an aperture in the end wall 50 of frame 14, and also in interior frame member 52, at which point a pin 53 engages a corresponding slot 54 in rod 48 to hold it in position.

A pelvic traction cable 56 emanates from beneath frame 14, passes through the center of pelvic support rod 48, turns a pulley 58, and attaches to a pelvic spreader 60. Spreader 60 attaches to a pelvic traction belt 62 circumscribing the waist and hips of patient 12 to apply traction forces to the patient.

A countertraction belt 64 circumscribes the lower rib cage of patient 12 during the application of pelvic traction. A pair of straps 66 connect countertraction belt 64 to hooks 68 on the upper surface 16 of frame 14. Accordingly, when traction forces are applied on pelvic traction belt 62, countertraction belt 64 provides opposing forces so that the traction belts simply do not move the patient.

A chain 70 is located within frame 14 beneath upper surface 16. Chain 70 circumscribes a drive sprocket 72 mounted on drive shaft 74, and an idler sprocket 76 mounted on an idler shaft 78. Tension of the chain is maintained by bolts 79, 80 extending from support plate 81 to idler shaft 78. Cervicle traction cable 38 is attachable to the lower run of chain 70. Pelvic traction cable 56 is attachable to the upper run of chain 70. Accordingly, movement of chain 70 in a counterclockwise direction (FIG. 4) takes up both cervicle traction cable 38 and pelvic traction cable 56. Of course, usually only one of the cables is attached to the chain at any one time.

Figure 2:
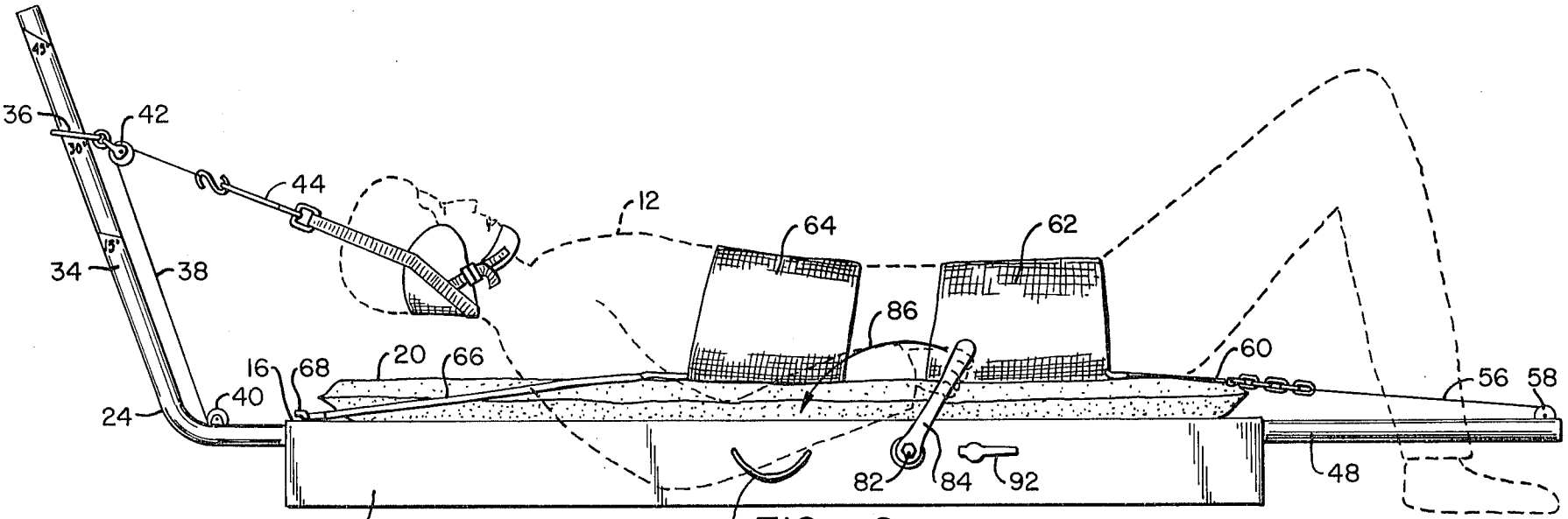
FIG. 2 is a side elevation view of the embodiment of FIG. 1.
Figure 3:
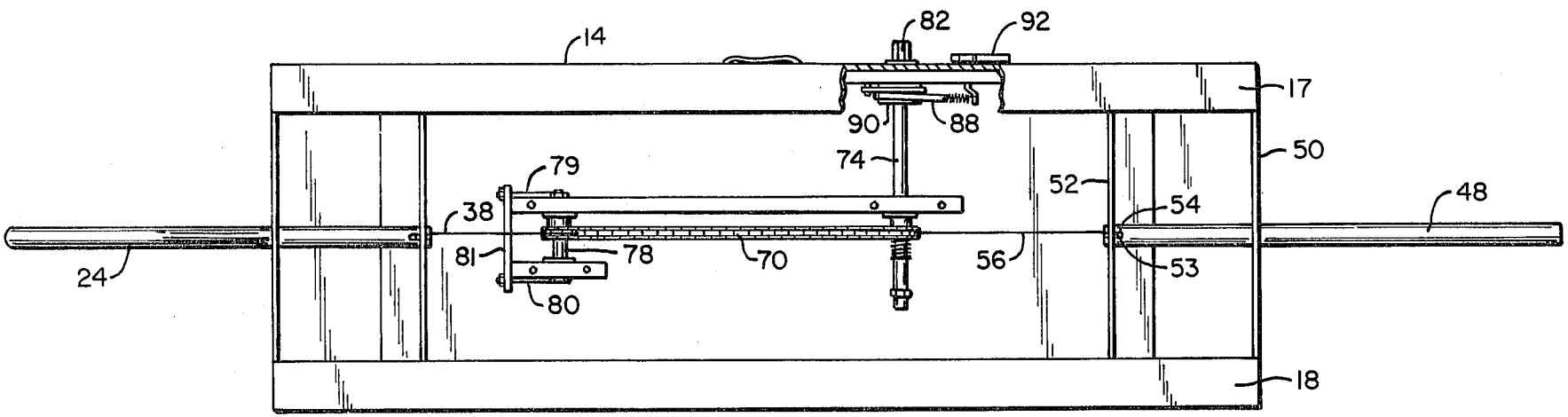
FIG. 3 is a bottom view of the embodiment of FIG. 1.

Drive shaft 74 has a head 82 on one end extending outside frame 14. The ratchet handle 84 attaches to head 82, and can be cycled through an arc by patient 12 to rotate drive shaft 82 in a counterclockwise direction as illustrated by arrow 86 (FIG. 2). Movement of ratchet handle 84 moves drive shaft 74 in a counterclockwise direction, while return movement of the ratchet handle in a clockwise direction does not force the drive shaft to rotate. A spring brake 88 circumscribes a brakedrum 90 attached to drive shaft 74 and prevents rotation of drive shaft 74 in a clockwise direction unless the spring brake is released using lever 92.

Figure 5A:
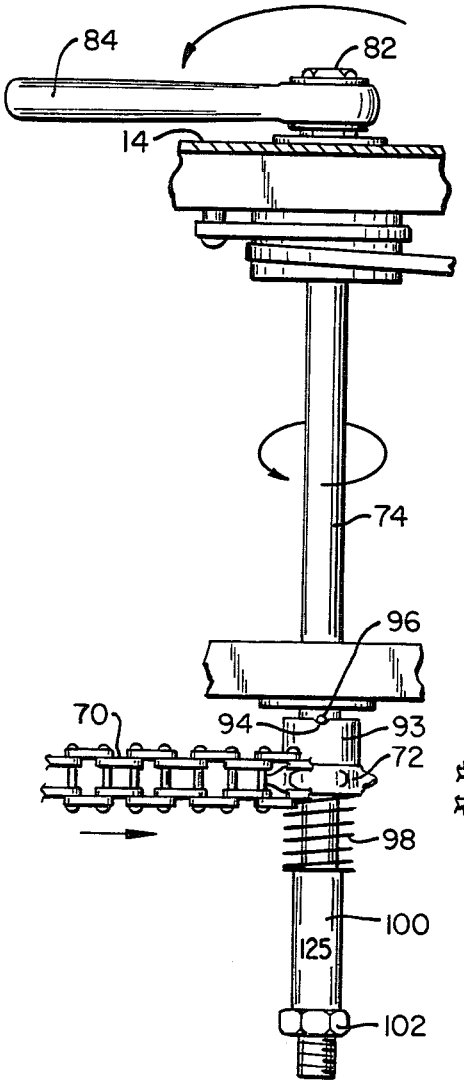
FIGS. 5A and 5B are enlarged fragmentary views of the takeup mechanism in the embodiment of FIG. 1 in its engaged and disengaged positions respectively.
Figure 5B:
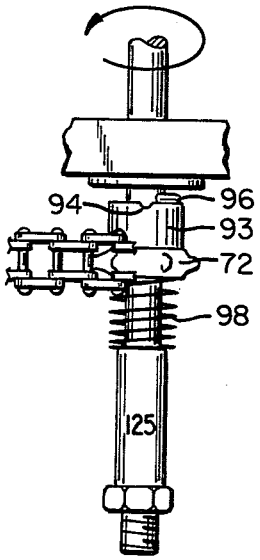

Rotation of drive shaft 74 using ratchet handle 84 causes chain 70 to move in a counterclockwise direction. As illustrated in detail by way of reference to FIGS. 5A and 5B, drive sprocket 72 includes a collar 93. Collar 93 has a detent 94 generally engaged by a projection 96 on drive shaft 74 (FIG. 5A). As a result, rotation of drive shaft 74 causes corresponding rotation of sprocket 72 and chain 70 to take up the traction cables.

Detent 94 is maintained in engagement with projection 96 by a spring 98 circumscribing drive shaft 72. A spacer 100 is fixed in position using a nut 102, and the length of spacer 100 determines the spring force applied by spring 98 to keep projection 96 engaged by detent 94.

Traction is applied by the operator, usually patient 12, cycling ratchet handle 84. Movement of ratchet handle 84 in a counterclockwise direction increases the tension applied, until the bias force of spring 98 is overcome and projection 96 becomes disengaged from detent 94. At this point, sprocket 72 will slip through one or more revolutions until spring 98 is able to re-engage projection 96 with detent 94. At that point, the traction force remains constant, and further cycling of ratchet handle 84 merely renews the slippage. As a result, traction forces cannot be applied significantly greater than that determined by the selected spacer 100.

Figure 6:
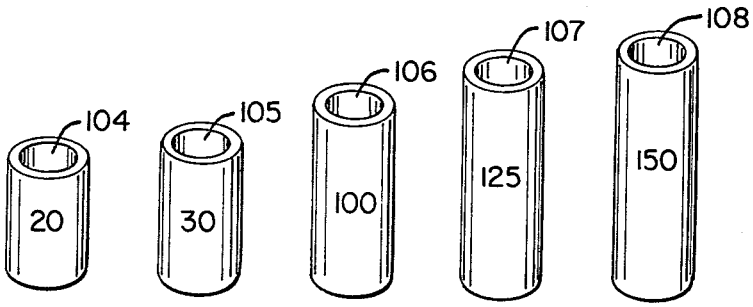
FIG. 6 is a perspective view of the spacers used in the takeup mechanism of FIGS. 5A and 5B.

As illustrated in FIG. 6, a plurality of spacers 104–108 are provided with the traction device of the present invention. The various spacers 104–108 each have different lengths, and are marked with indicators of the force supplied when various spacers are used. Typically, short spacers generating 20 or 30 lbs. of force are used for cervicle traction, and largers spacers generating forces of 100, 125 and 150 lbs. are used for pelvic traction.

In operation, traction device 10 can be readily carried from one place to another until the device is to used to apply traction. Pad 20 and the appropriate implements are then removed from frame 14, and the device is assembled, typically either to apply cervicle traction or pelvic traction but not both. The appropriate halters and belts are secured to the patient, and the patient attaches handle 84 and cycles it to apply the desired traction forces. The spacer chosen determines the amount of force that can be applied, the overrotation of the ratchet handle merely results in slippage to prevent excess forces being applied to the patient.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims:

What is claimed is:

1. A traction device comprising:

a portable frame having an upper surface adapted to support an individual to be subjected to traction, and a pair of rods releasably engageable with the frame proximate the opposite ends of the upper surface and providing mounting points spaced from said upper surface;

a pair of tension members emanating from the underside of the frame and having free ends passing through the respective mounting points and back toward the upper surface of the frame;

means for securing the free end of one of the tension members to the individual to be subjected to traction;

a chain having upper and lower runs parallel to the upper surface defined by spaced sprockets, one of the tension members being attachable to the upper run of the chain and the other tension member being attachable to the lower run of the chain, one of the sprockets having a transverse detent;

a rotatable shaft including a handle manually operable by the individual to be subjected to traction, said shaft projecting through the sprocket having the detent and having a radial projection proximate the detent;

a spring biasing the sprocket having the detent against the projection so that the detent engages the projection until the applied tension in one of the tension members reaches a preselected value, beyond which the projection becomes disengaged from the detent to prevent the applied tension from exceeding the preselected value;

means for varying the force of the spring to select the desired tension; and a brake preventing the shaft from rotating in a direction to release the appied tension so that the preselected tension value is maintained.

2. The traction device of claim 1 wherein the securing means includes a pelvic strap assembly attachable to one of the tension members and to secured to the patient to provide pelvic traction, and a cervicle halter attachable to the other tension member and secured to the patient to provide cervicle traction.

3. The traction device of claim 2 wherein the rod providing the mounting point for the tension member associated with the cervicle halter has a vertical portion, and wherein the mounting point associated with cervicle traction is movable along the vertical portion of said rod to vary the angle at which the cervicle traction is applied.

4. The traction device of claim 2 wherein the portable frame includes a pair of hooks on its upper surface, and wherein the securing means includes a countertraction belt attachable to the patient below the rib cage and connected to the hooks to provide countertraction during the application of pelvic traction.

* * * * *